US006394582B1

(12) United States Patent
Koeda

(10) Patent No.: US 6,394,582 B1
(45) Date of Patent: May 28, 2002

(54) INK JET HEAD AND INK JET RECORDER MOUNTED WITH THE SAME

(75) Inventor: Hiroshi Koeda, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/297,107

(22) PCT Filed: Sep. 10, 1998

(86) PCT No.: PCT/JP98/04065

§ 371 (c)(1),
(2), (4) Date: Apr. 23, 1999

(87) PCT Pub. No.: WO99/12739

PCT Pub. Date: Mar. 18, 1999

(30) Foreign Application Priority Data

Sep. 11, 1997 (JP) ..... 9-247112

(51) Int. Cl.[7] ..... B41J 2/04
(52) U.S. Cl. ..... 347/54
(58) Field of Search ..... 347/54, 68, 69, 347/70, 71, 72, 50, 40; 399/261; 361/700; 310/328–330; 29/890.1

(56) References Cited

U.S. PATENT DOCUMENTS 5,818,473 A * 10/1998 Fujii et al. ..... 347/11
6,130,691 A * 10/2000 Takemoto et al. ..... 347/55

FOREIGN PATENT DOCUMENTS

JP 55095191 7/1980

OTHER PUBLICATIONS

Patent Abstract of Japan Publication No.: 06071882 A Published Mar. 15, 1994.

* cited by examiner

*Primary Examiner*—Raquel Yvette Gordon
(74) *Attorney, Agent, or Firm*—Ladas & Parry

(57) ABSTRACT

An ink jet head for applying electrical pulses between diaphragms and electrodes to charge/discharge therebetween to transform the diaphragms to thereby eject ink drops from nozzle holes. Electrostatic actuators 50 constituted by scanning electrodes (60, 61 to 64) provided on a plurality of diaphragms respectively and counter electrodes (10, 11 to 1n) are arranged in a matrix. Scanning pulses (61*a* to 64*a*) synchronized with a clock (30*a*) are supplied to the scanning electrodes (61 to 64) sequentially, respectively. Driving pulses corresponding to printing data (11*a* to 1n*a*) having opposite potential to that of the scanning pulses and being synchronized with the clock (30*a*) are supplied to the counter electrodes (11 to 1n). When a potential difference between any one of the scanning electrodes (60, 61 to 64) and corresponding one of the counter electrodes (11 to 1n) reaches a predetermined voltage V, the electrostatic actuator (50) with the potential difference is driven so as to eject an ink drop.

15 Claims, 17 Drawing Sheets

INK JET HEAD AND INK JET RECORDER MOUNTED WITH THE SAME

TECHNICAL FIELD

The present invention relates to an ink jet head for ejecting ink drops onto paper or the like to thereby perform printing, and an ink jet recording apparatus mounted therewith.

BACKGROUND TECHNIC

Recently, a very small actuator has been required in ink jet recording apparatus because of high-speed printing and miniaturization of the apparatus due to multiplication of nozzles. Therefore, there is proposed an ink jet recording apparatus using electrostatic power for an actuator (for example, JP-A-6-71882). In this ink jet recording apparatus, the actuator is constituted by parallel plate electrodes, so that there is a feature that the actuator can be miniaturized and a multi-nozzle can be realized.

The summary of an ink jet head driven by this electrostatic actuator will be described with reference to the sectional view of FIG. 21 and the plan view of FIG. 22. The ink jet head in FIGS. 21 and 22 has a lamination structure in which an electrode glass substrate 100, a diaphragm substrate 200 and a nozzle plate 300 are laminated and bonded with each other. Ink 400 supplied to a reservoir 204 from an ink supply port 104 opened in the electrode glass substrate 100 is distributed to a plurality of cavities 203 equally by an orifice 302. Under the lower side of the cavity 203, a transformable diaphragm 201 is formed so as to constitute an electrostatic actuator 50, facing an counter electrode 10 through an insulating film 202 for preventing shortcircuit. A voltage is applied between the diaphragm 201 and the counter electrode 10 with aid of a common electrode (GND) 20, so that all electrostatic force is generated to thereby transform the diaphragm 201 downward. Then, an ink drop 401 is ejected from a nozzle 301 by the pressure due to a spring force of the diaphragm 201 generated when the applied voltage is removed.

However, in a direct driving system in which voltages are applied to individual counter electrodes 10 directly, n wires for the counter electrodes 10 and one wire for the common electrode (GND) 20, that is, (n+1) wires in total from a control circuit are required when n electrostatic actuators ($C_1$ to $C_n$) 50 are provided, as shown in the circuit diagram of FIG. 23. Therefore, not only the space for the wiring connection portion is increased, but also it is difficult to ensure the reliability. Particularly, the electrostatic capacity of the electrostatic actuators 50 is so small. It is accordingly coupled to the electrostatic capacity of the respective wires from the common electrode (GND) 20 to cause a possible nonuniformity in the electric characteristic of the electrostatic actuators 50. In addition, the number of ICs required for driving actuators corresponds to the number of the actuators. Accordingly, the cost of a driving circuit is increased.

For Such reasons, in order to reduce the space for the wiring connection portion, such a system is proposed that a latch circuit connected to actuators and an integrated circuit for controlling the latch circuit are installed in a head so as to reduce the number of wires. In this system however, the head itself becomes complicated and expensive because of the integrated circuit installed in the head though the reliability of the connection portion can be improved.

SUMMARY OF THE INVENTION

It is an object of the present invention to provide an ink jet head, in which

DISCLOSURE OF THE INVENTION

It is an object of the present invention to provide an ink jet head, in which the total number of wires and the total number of driving ICs are reduced so as to reduce the space for the wiring connection portion, and which is low in price and high in practical reliability.

It is another object of the present invention to provide an ink jet head in which printing accuracy is improved in addition to the above-mentioned object.

It is further object of the present invention to provide an ink jet recording apparatus mounted with the above-mentioned ink jet head.

(1) According to the present invention, provided is an ink jet head comprising a plurality of nozzle holes, a plurality of independent ejection chambers communicating with the nozzle holes respectively, diaphragms constituting at least one-side walls of the ejection chambers respectively, counter electrodes opposite to the diaphragms through air gaps respectively, and a control circuit for applying electric pulses between the diaphragms and the electrodes to charge/discharge therebetween to thereby transform the diaphragms to eject ink drops from the nozzle holes, wherein electrostatic actuators constituted by the diaphragms and the counter electrodes respectively are arranged in a matrix electrically.

(2) According to the present invention, in the ink jet head stated in the above paragraph (1), electrodes the potentials of which are controlled individually are formed on the diaphragms respectively.

(3) According to the present invention, in the ink jet head stated in the above paragraph (2), the control circuit scans the potential of either one of the electrodes formed on the diaphragms or the counter electrodes sequentially.

(4) According to the present invention, in the ink jet head stated in the above paragraph (3), the control circuit applies voltages to the counter electrodes with polarity opposite to that of voltages applied to the electrodes formed on the diaphragms respectively.

In the present invention, electrostatic actuators constituted by diaphragms and counter electrodes are arranged in a matrix. By use of the non-linear characteristic of the electrostatic actuators themselves, time sharing driving can be realized. It is therefore possible to reduce the number of wires and the number of driving ICs without using complicated and expensive integrated circuits or the like.

(5) According to the present invention, in the ink jet head stated in the above paragraph (2), (3) or (4), the control circuit periodically inverts the polarity of electrical pulses applied between the electrodes formed on the diaphragm and the counter electrodes respectively.

(6) According to the present invention, in the ink jet head stated in the above paragraph (5), the control circuit inverts the polarity of the electrical pulses applied between the electrodes formed on the diaphragms and the counter electrodes whenever the control circuit scans an electrode to be scanned.

(7) According to the present invention, in the ink jet head stated in the above paragraph (5), the control circuit inverts the polarity of electrical pulses applied between the electrodes formed on the diaphragms and the counter electrodes respectively whenever the control circuit finishes scanning over all of the electrodes to be scanned.

As mentioned above, in the present invention, the direction of charging to the electrostatic actuators is switched between forward and reverse directions alternately. Accordingly, residual charge after ink ejection is erased, so that the relative quantity of displacement between the diaphragms and the electrodes becomes stable at the time of printing. Therefore, high-resolution printing can be realized.

(8) According to the present invention, in the ink jet head stated in any one of the above paragraphs (3) to (7), the control circuit controls electrodes to be scanned respectively so as to allocate ink colors to the electrodes. Accordingly, color printing can be realized with one head.

(9) In addition, an ink jet recording apparatus according to the present invention is mounted with the above-mentioned ink jet head so as to realize an ink jet recording apparatus by which high-quality printing can be realized.

THE BEST MODE FOR CARRYING-OUT THE INVENTION

Embodiment 1.

Description will be made about the principles of driving an electrostatic actuator prior to the description of an embodiment of the present invention. In an electrostatic actuator, when a diaphragm thereof is displaced so as to reduce the inter-electrode distance, electrostatic attraction force P is increased in proportion to the square of the inverse number of the inter-electrode distance, as shown in the following expression.

$$P=0.5e(V/d)^2$$

e: permittivity of the air
d: inter-electrode distance
V: applied voltage

Figure 1:
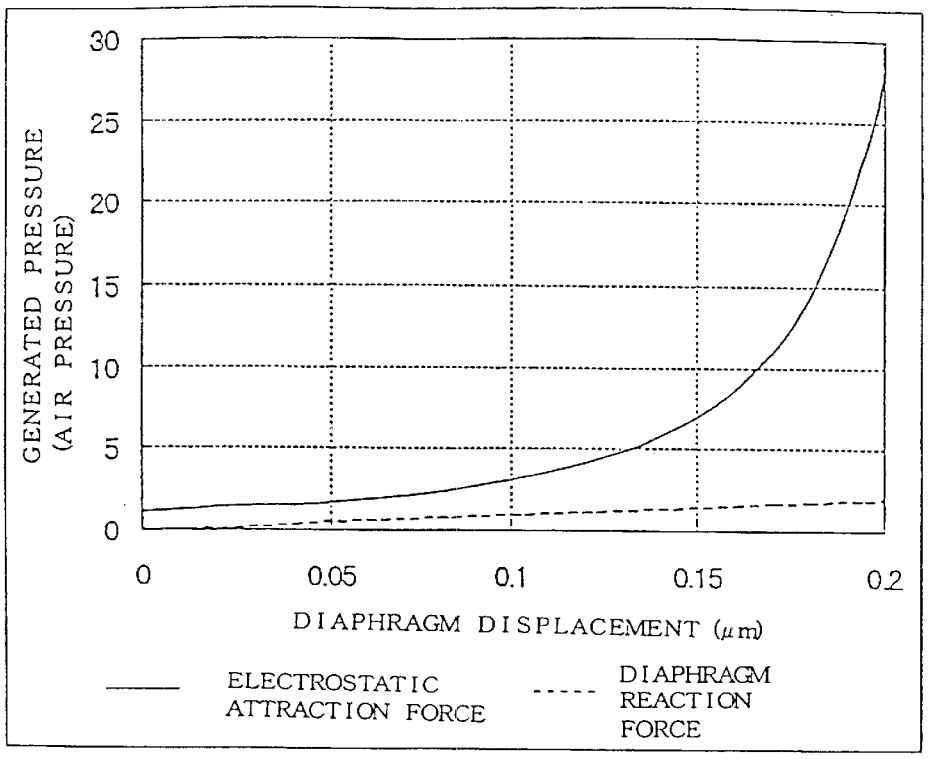
FIG. 1 is a characteristic graph showing the relationship between displacement of a diaphragm and reaction force and electrostatic attraction force of the diaphragm in an electrostatically driving ink jet when a constant voltage is applied thereto.

Here, an air layer and an insulating film are formed between the electrodes. Therefore, when the thickness of the insulating film is converted into the thickness of the air, the following expression is established.

$$d=da+(e/ei)di$$

da: thickness of air layer
ei: permittivity of insulating layer
di: thickness of the insulating layer The reaction force of the diaphragm which is a repulsion force caused by displacement of the diaphragm is simply proportional to the displacement. The reaction force F of the diaphragm to the inter-electrode distance d is given by the following expression.

$$F=k(d1-d)$$

d1: distance between the diaphragm and the counter electrode in the initial state
k: spring constant of the diaphragm When the diaphragm is displaced in such a direction that the inter-electrode distance d is reduced in the case where the applied voltage is constant, the relationship between the reaction force generated in the diaphragm and the electrostatic attraction force is as shown in the characteristic graph of FIG. 1. From the characteristic shown in FIG. 1, it is understood that the electrostatic attraction force given to the diaphragm increases suddenly as the displacement increases to thereby reduce the distance d.

Figure 2:
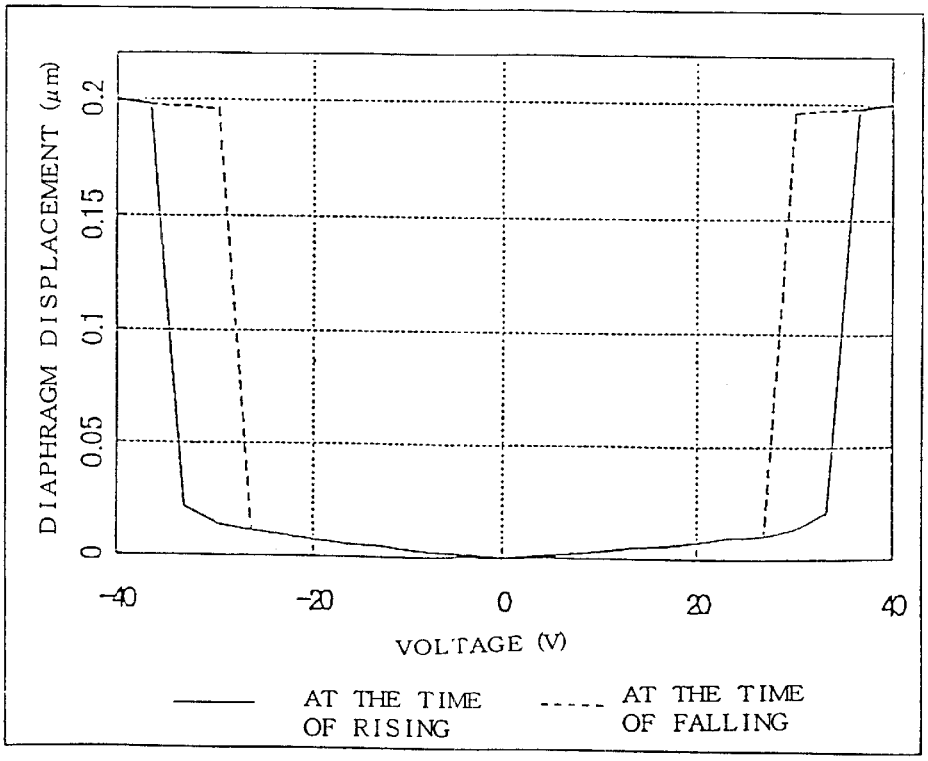
FIG. 2 is a characteristic graph showing the relationship between the displacement of a diaphragm and the applied voltage in the electrostatically driving ink jet.

In addition, the relationship between the driving voltage and the actual quantity of displacement of the diaphragm is as shown in FIG. 2. For example, when the driving voltage is increased gradually from 0V at the time of increase of the voltage, the diaphragm is displaced in a position to balance with the reaction force of the diaphragm because the electrostatic attraction force increases gradually in the beginning. Although it seems that the electrostatic attraction force and the diaphragm reaction force do not balance with each other in FIG. 1, there is a case where the electrostatic attraction force and the diaphragm reaction force balance with each other when the applied voltage is smaller than that in FIG. 1. However, the electrostatic attraction force increases suddenly, and exceeds the value of the increased diaphragm reaction force, so that the displacement diverges. After the divergence, the diaphragm contacts with the counter electrode, so that the displacement is fixed even if the voltage increases. Next, at the time of decrease of the voltage, the inter-electrode distance is minimal because of the contact, so that the contact is kept even after the point where the displacement is diverged at the time of increase of the voltage. Accordingly, the contact is released at a position where the voltage is lower. As a result, there appears a non-linear histeresis curve as shown in FIG. 2. Although the above description has been made about the case where the applied voltage is increased from 0V to a positive value, a similar phenomenon is obtained also in the case where the voltage is increased from 0V to a negative value.

Figure 3A:
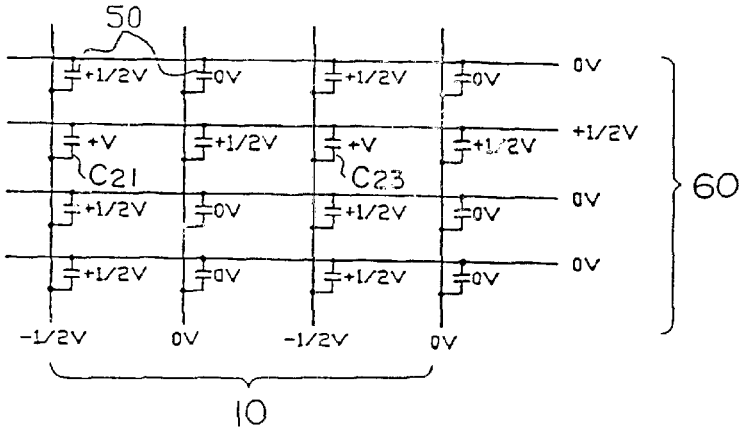
FIGS. 3A to 3C are electric potential diagrams of electrostatic actuators at the time of time-sharing driving in the present invention.
Figure 3B:
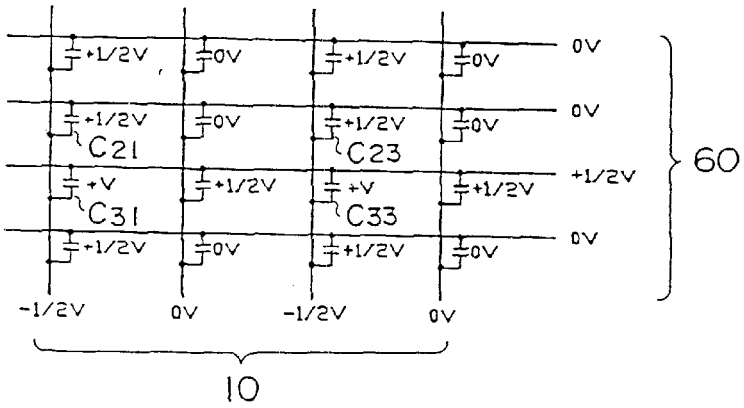
Figure 3C:
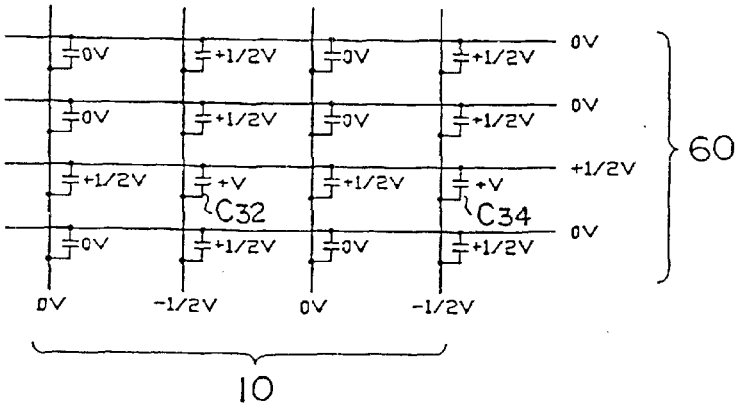

FIGS. 3A to 3C are electric potential diagrams of electrostatic actuators when actuators 50 are driven in time sharing on the basis of the above-mentioned operation principles. The electrostatic actuators 50 are arranged in a matrix electrically by arranging counter electrodes 10 and scanning electrodes 60 so as to cross each other, as shown in FIGS. 3A to 3C. Diaphragms of the electrostatic actuators 50 are so set that the diaphragms are displaced to contact with the counter electrodes 10 with voltages of ±V, and released from the contact state with voltages of ±½V. A voltage of +½V is applied to the scanning electrodes 60 sequentially, and a voltage of −½V (having opposite polarity to that of the voltage applied to the scanning electrodes 60) is applied to desired ones of the counter electrodes 10.

The diaphragms of the electrostatic actuators 50 taking +V as the potential difference between a scanning electrode 60 and the counter electrodes 10 come into contact with the counter electrodes 10. On the other hand, the diaphragms of the electrostatic actuators 50 in which no voltage is applied to the counter electrodes 10 take +½V or 0V as the potential difference between the scanning electrode 60 and the counter electrodes 10, so that the diaphragms do not contact with the counter electrodes 10 (FIG. 3A). Then, when the potential moves to the next scanning electrode 60, the potentials of the electrostatic actuators 50 in the contact state take +½V or 0V, so that the electrostatic actuators 50 are released from the contact state and return to their initial state (FIGS. 3B and 3C). With aid of scanning the voltage of the scanning electrodes 60 in such a manner, it is possible to drive desired ones of the electrostatic actuators 50. Then, it is assumed that the timing to apply a voltage of −½V to the counter electrodes 10 is synchronized with scanning of voltage of the scanning electrodes 60.

FIG. 3A shows an example in which electrostatic actuators $C_{21}$ and $C_{23}$ are driven by scanning a scanning electrode 60 in the second line and applying a voltage to counter electrodes 10 in the first and third columns (outputting printing data). On the other hand, FIGS. 3B and 3C show examples in which a scanning electrode 60 in the third line is scanned. In FIG. 3B, the voltage is applied to counter electrodes 10 in the first and third columns so as to drive electrostatic actuators $C_{31}$ and $C_{33}$, while in FIG. 3C, the voltage is applied to counter electrodes 10 in the second and fourth columns so as to drive electrostatic actuators $C_{32}$ and $C_{34}$.

Thus, the operation principles of the electrostatic actuators 50 arranged in a matrix is shown clearly. Next, description will be made about an ink jet head according to a first embodiment of the present invention.

Figure 4:
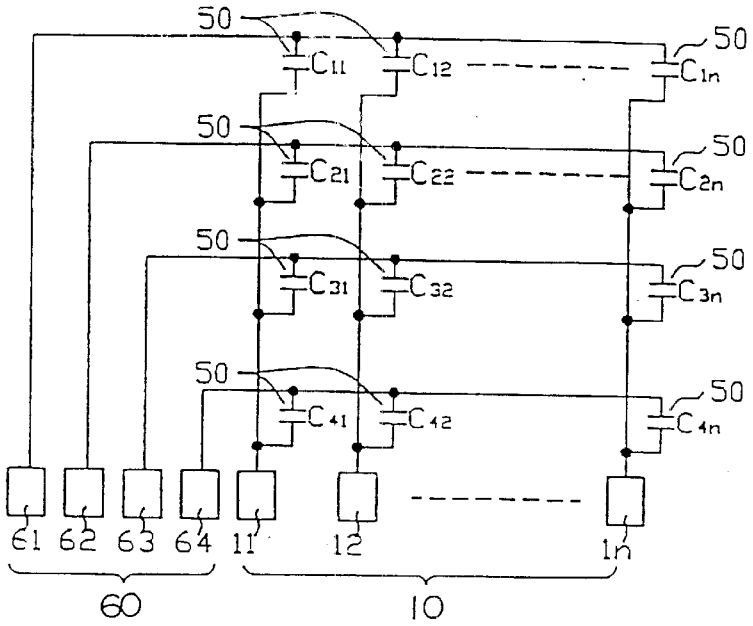
FIG. 4 is an electric connection diagram of an ink jet head according to a first embodiment of the present invention.
Figure 5:
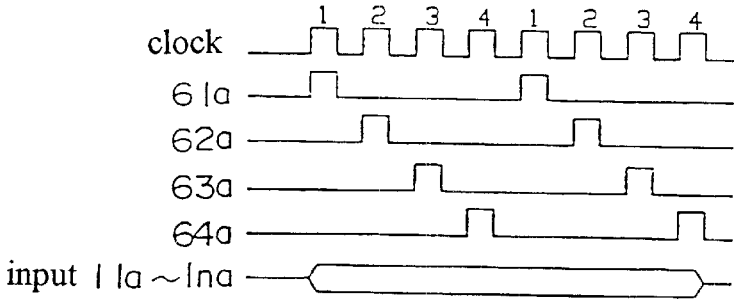
FIG. 5 is a timing chart showing the operation of the ink jet head according to the first embodiment.

FIG. 4 is an electrical connection diagram in the first embodiment of the present invention. FIG. 5 is a timing chart of its operation. Description will be made below about the case where 4×n electrostatic actuators ($C_{11}$ to $C_{4n}$) 50 are driven. This embodiment shows an example of face-eject type ink jet head in which ink drops are ejected from nozzle holes provided in a surface portion of a substrate. It is here assumed that scanning electrodes 60 are constituted by four scanning electrodes 61 to 64 and counter electrodes 10 are constituted by n counter electrodes 11, 12 . . . 1n. Line scanning pulses 61*a* to 64*a* having the potential of +20V and synchronized with a control clock are inputted to the respective scanning electrodes 61 to 64 sequentially, as shown in FIG. 5. At this time, driving pulses having the potential of −20V opposite to that of the scanning pulses and synchronized with the control clock in the same manner as the line scanning pulse are inputted to desired ones of the counter electrodes 11 to in as printing data 11*a* to 1n*a*.

Figure 6:
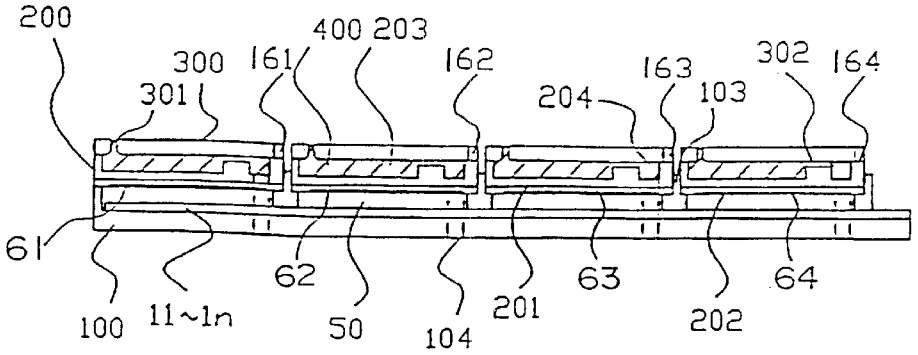
FIG. 6 is a sectional view of the ink jet head according to the first embodiment.
Figure 7:
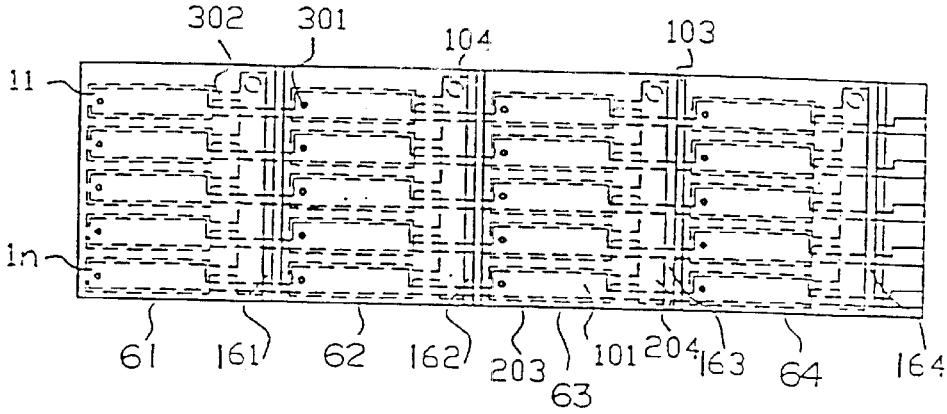
FIG. 7 is a plan view of the ink jet head in FIG. 6.

FIGS. 6 and 7 are a sectional view and a plan view of the ink jet head in this embodiment, respectively. The ink jet head in this embodiment has a structure in which a nozzle plate 300 of a single-crystal silicon substrate, a diaphragm substrate 200 and an electrode glass substrate 100 of borosilicate glass are laminated. The electrode glass substrate 100 and the diaphragm substrate 200 are bonded by anode bonding, while the diaphragm substrate 200 and the nozzle plate 300 are bonded with epoxy bonding agent. In addition, scanning line connection electrodes 161 to 164 are exposed from the electrode glass substrate 100, and connected to scanning electrodes 61 to 64, respectively.

In addition, electrostatic actuators 50 in this embodiment are arranged in a matrix of n lines 4 columns in the head. Because the electrostatic actuators 50 are arranged in four columns, full-color printing can be attained with one head by allocating the respective columns to R, G, B and black inks. The diaphragm substrate 200 of single-crystal silicon is so configured that the diaphragm substrate 200 is cut into four by anisotropic dry etching after anode bonding, and scanning electrodes 61 to 64 are formed in the four respectively, so that the respective potentials can be controlled individually.

The counter electrodes 11 to 1n formed on the electrode glass substrate 100 are connected over the four columns of electrostatic actuators 50. After the diaphragm substrate 200 is cut out, the counter electrodes 11 to 1n are sealed with a seal 103 of epoxy bonding agent along grooves formed by cutting. The natural frequency of a diaphragm 201 is 50kHz when a cavity 203 is filled with ink 400. However, practical ejection of ink is performed at 10kHz because 80 microseconds are required for attenuating the vibration of an ink meniscus of a nozzle 301 to be restored to its initial state. It is therefore possible to drive the respective columns of electrostatic actuators 50 in time sharing at 40kHz.

Embodiment 2.

Figure 8:
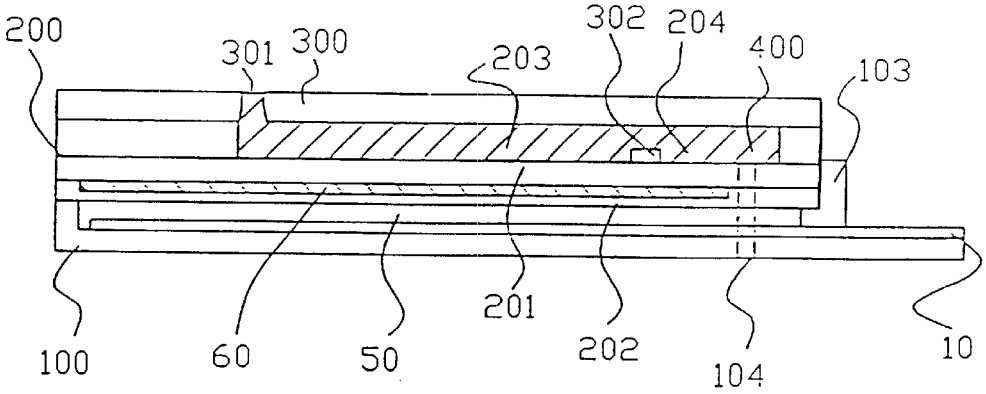
FIG. 8 is a sectional view of an ink jet head according to a second embodiment of the present invention.
Figure 9:
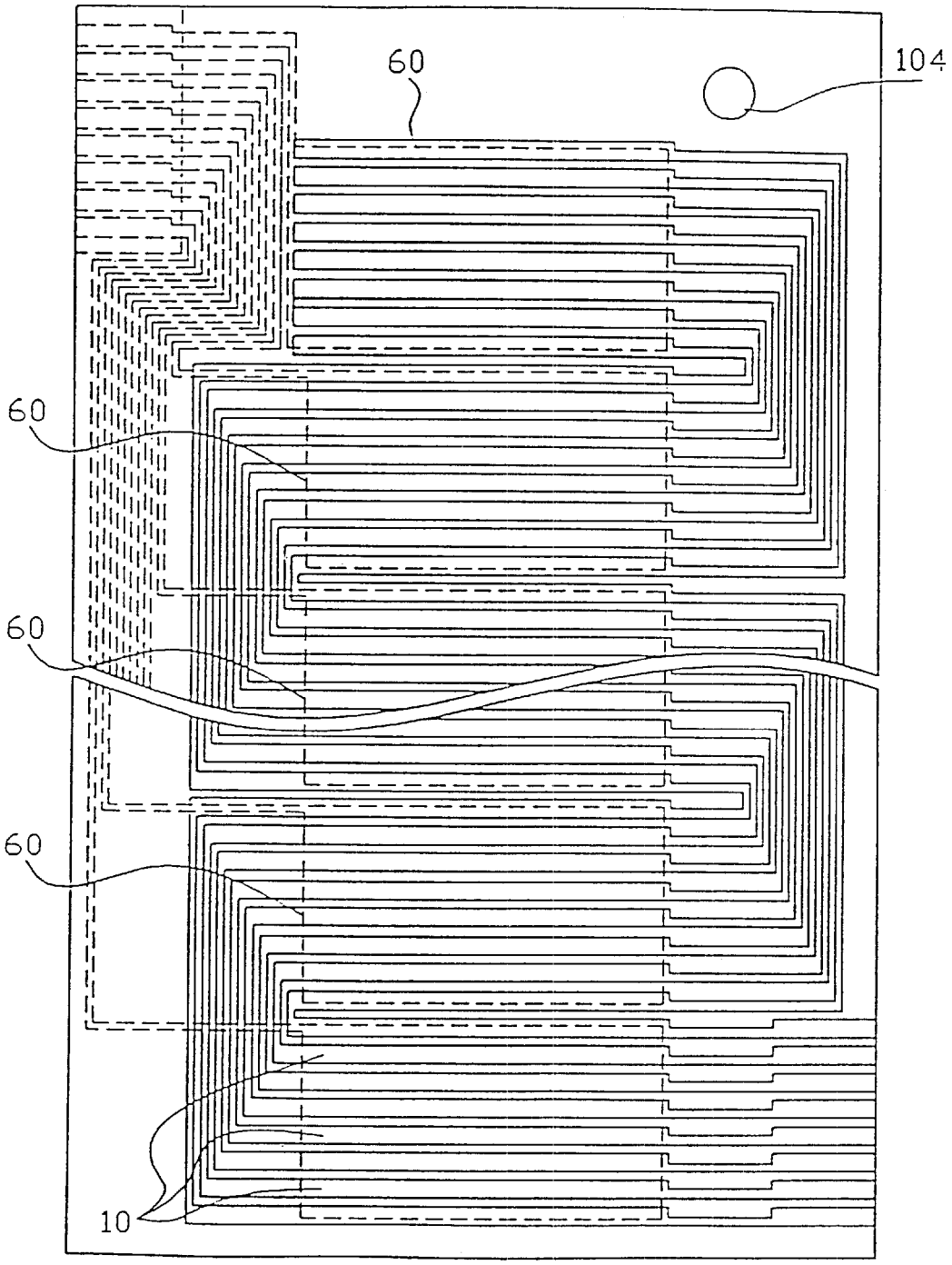
FIG. 9 is a plan view of the wiring portion of the ink jet head in FIG. 8.
Figure 10:
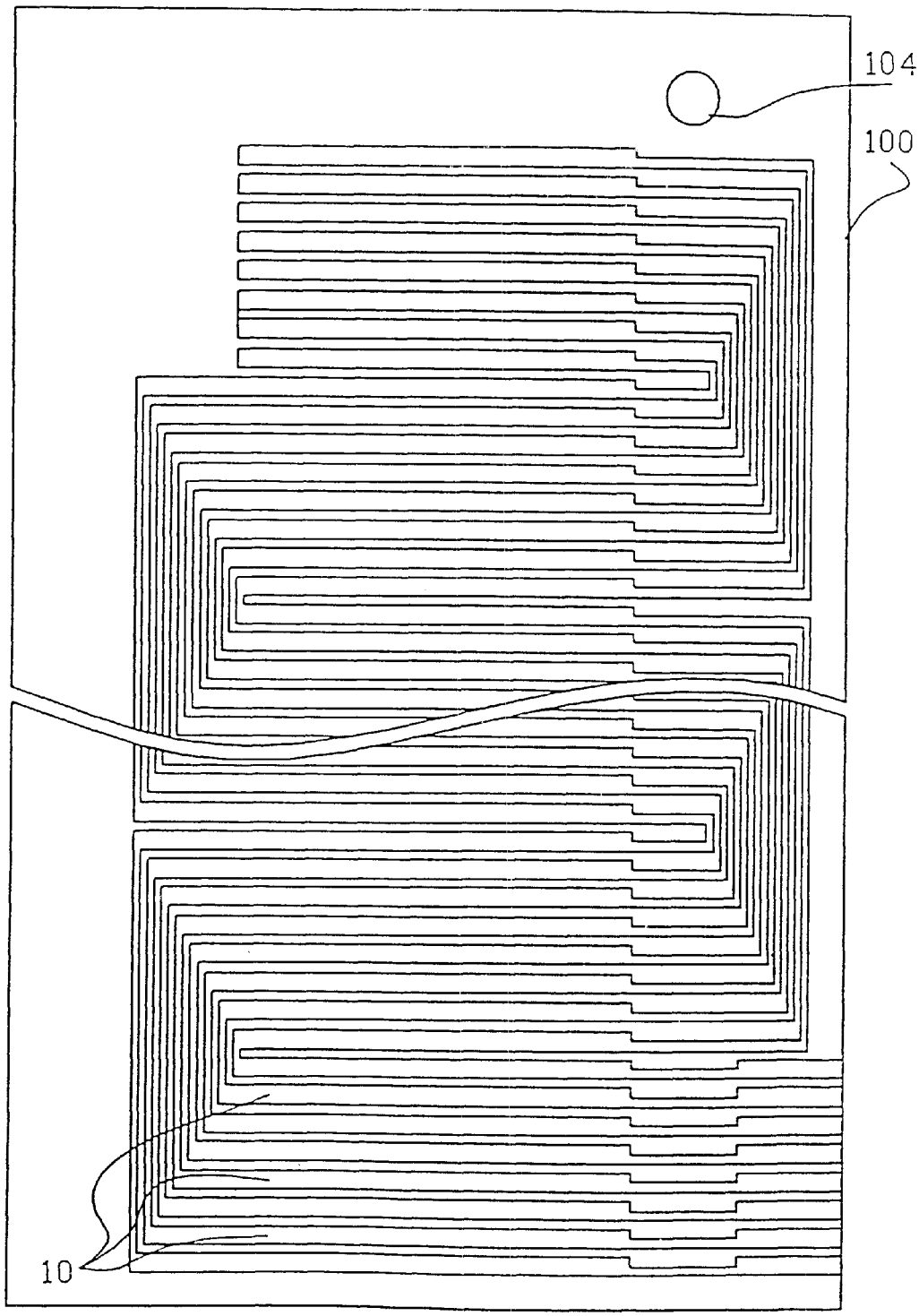
FIG. 10 is a plan view extracting counter electrodes from the wiring portion in FIG. 9.
Figure 11:
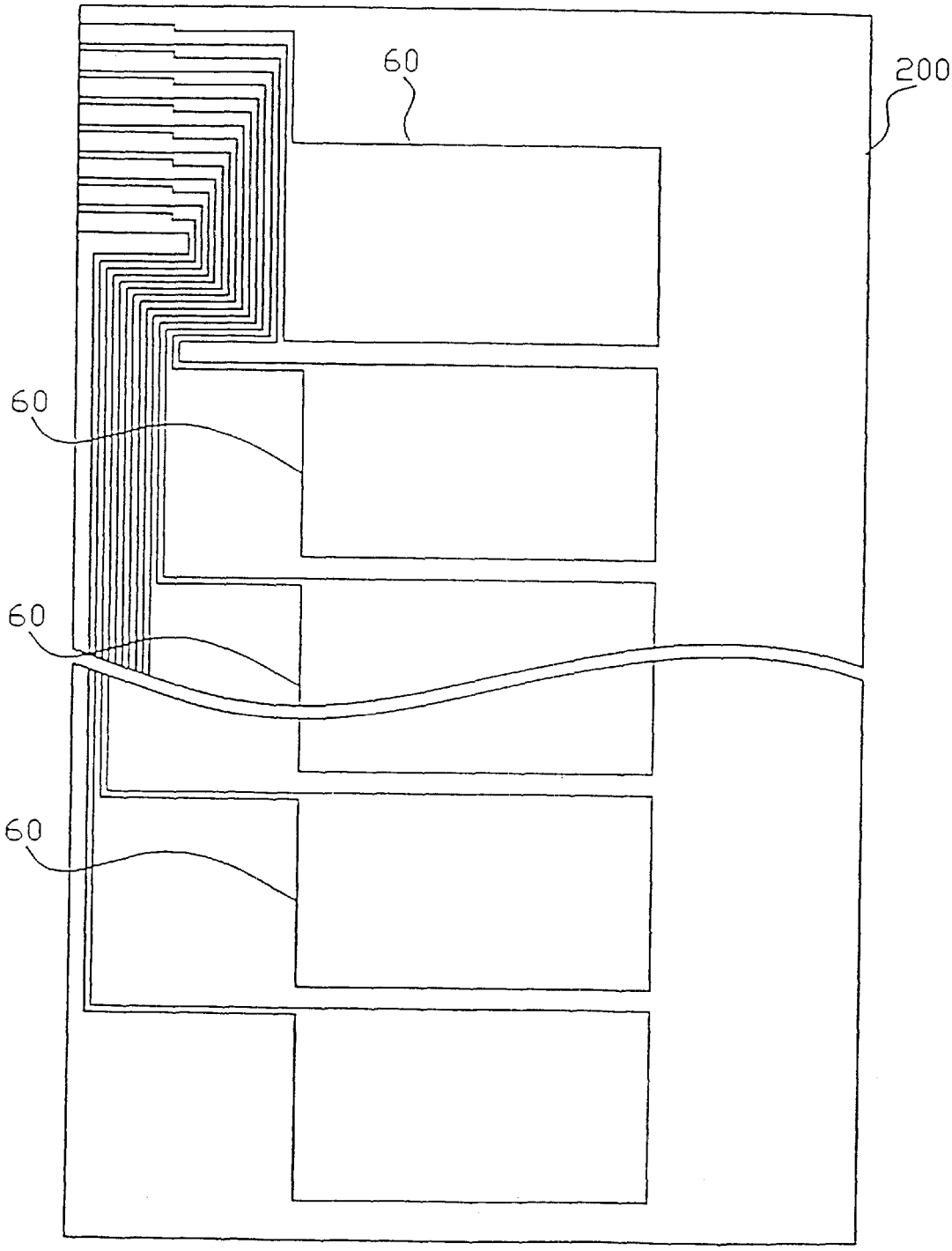
FIG. 11 is a plan view extracting scanning electrodes from the wiring portion in FIG. 9.
Figure 23:
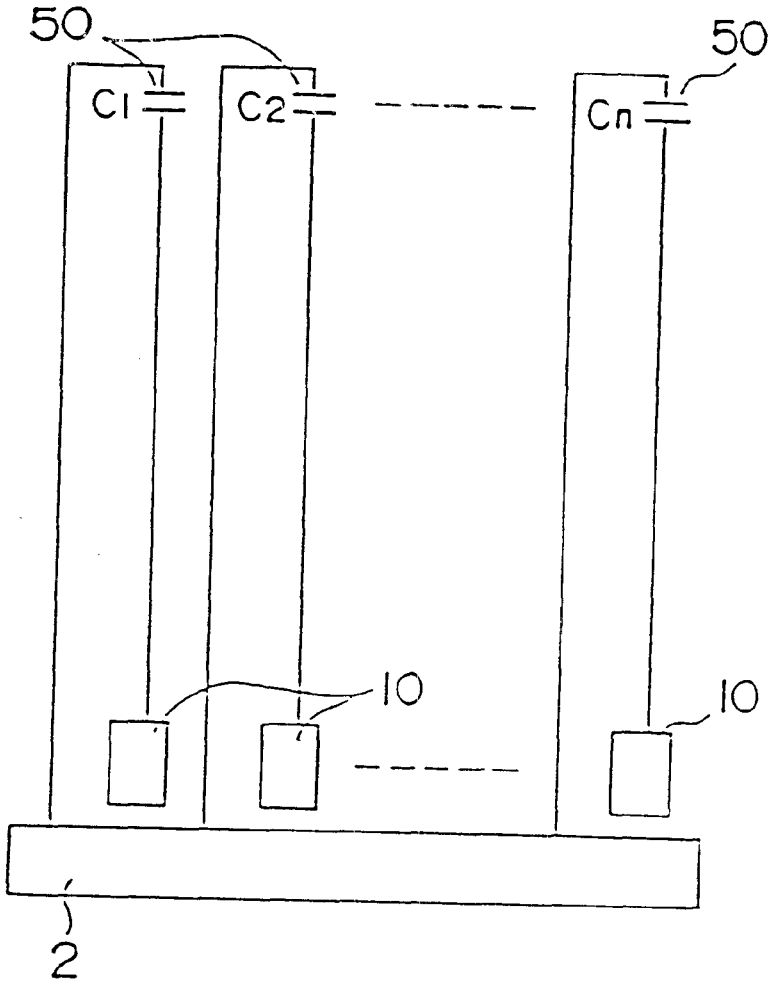
FIG. 23 is a circuit diagram of the ink jet head in FIG. 21.

FIG. 8 is a sectional view of an ink jet head according to a second embodiment of the present invention, and FIG. 9 is a plan view of counter electrodes and scanning electrodes. In addition, FIG. 10 is a plan view in which the counter electrodes in FIG. 9 are extracted, and FIG. 11 is a plan view in which the counter electrodes in FIG. 9 are extracted. For use in printing on narrow paper such as receipt printing, a so-called twin head is used in which a head feed mechanism is omitted by arranging a large number of nozzles in the same width as paper width and fixing the head. In such usage, at least 256 nozzles are required even in the case of 180 DPI (Dot Per Inch). Accordingly, the total number of wires for a common electrode and individual actuators is 257 in an independent wiring system (FIG. 23). It leads to such undesirable results as difficulty in ensuring the reliability of the wiring portions, and increase of the number of ICs for driving the actuators. As shown in the following Table 1, it is understood that the total number of scanning electrodes and counter electrodes is minimal when the number of the scanning electrodes is 16 and the number of the counter electrodes is 16. In this case, although the scanning period is prolonged according to the increased number of scanning electrodes, the printing speed is not lowered because the number of nozzles is extremely large in the case of a line printer.

TABLE 1

| Number of scanning electrodes | number of counter electrodes | total number of electrodes |
|---|---|---|
| 1 | 256 | 257 |
| 2 | 128 | 130 |
| 4 | 64 | 68 |
| 8 | 32 | 40 |
| 16 | 16 | 32 |

However, in a line printer, it is difficult that cavities 203 which are arranged in a line at fine pitches, are cut into 16 line blocks to make each of them to be electrically independent of each other. Accordingly, it is necessary to form the scanning electrodes 60 independently of the cavities 203.

FIG. 9 (FIGS. 10 and 11) shows an example in which the number of scanning electrodes 60 is 8 and the number of counter electrodes 10 is 8, for the sake of simplification. The counter electrodes 10 meander right and left with two-level crossing over the scanning electrodes 60, so as to form the electrostatic actuators 50 in a matrix. In this embodiment, a silicon nitride film having insulating properties which constitute a diaphragm 201 is formed by CVC on the lower surface of a diaphragm substrate 200 of single-crystal silicon, in order to form the scanning electrodes 60 electrically independently of the cavities 203. After forming the film, silicon is anisotropically etched with KOH water solution so as to form the cavities 203 and reservoirs 204. The scanning electrodes 60 are formed on the lower surface of the diaphragm 201 by photolithography after sputtering of Au, and insulated from the counter electrodes 10 by an insulating film 202 of silicon dioxide. An electrode glass substrate 100 on which the winding counter electrodes 10 are formed, the diaphragm substrate 200, and a nozzle plate 300 are laminated, and sealed with a sheet 103. Thus, the ink jet head is completed.

Embodiment 3.

Figure 12A:
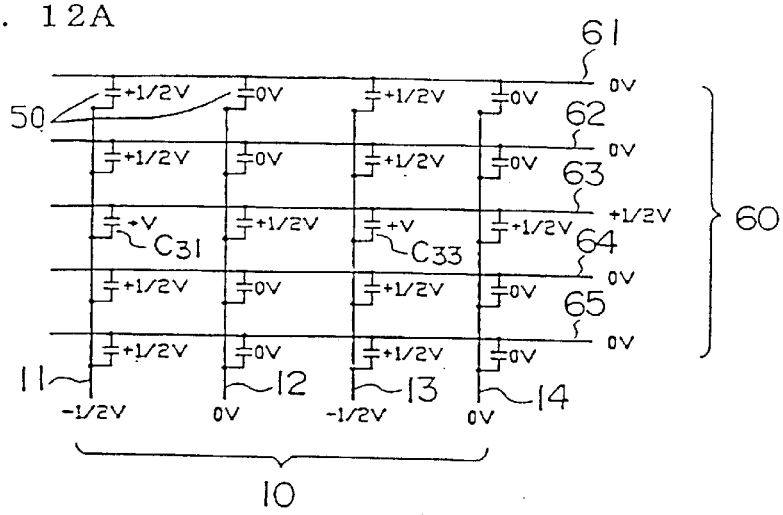
FIGS. 12A to 12C are electric potential diagrams of electrostatic actuators according to a third embodiment of the present invention.
Figure 12B:
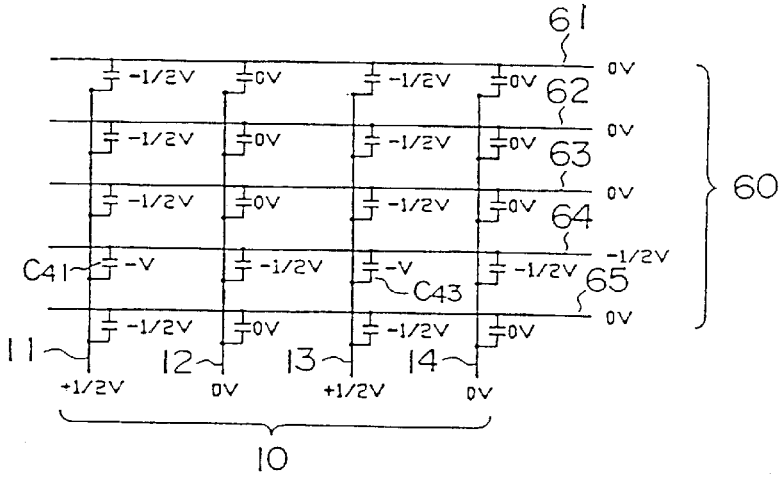
Figure 12C:
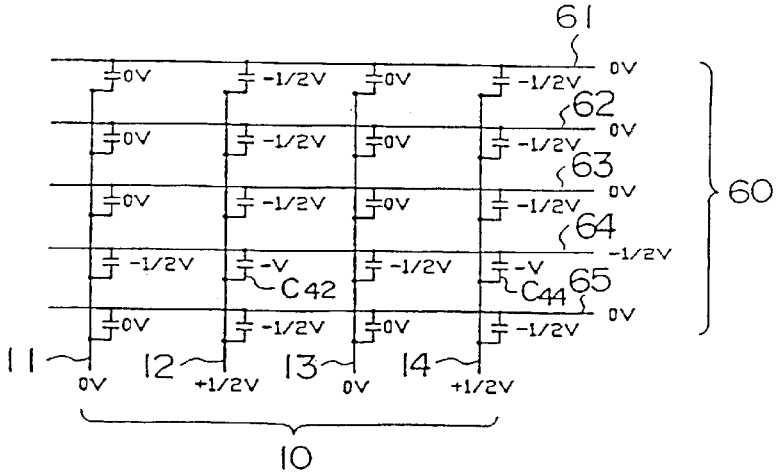

FIGS. 12A to 12C are electric potential diagrams of a third embodiment of the present invention. In this embodiment, the number of scanning electrodes is set to be odd, and the polarities of scanning electrodes 60 and counter electrodes 10 are switched synchronously with a clock. When the potential of a scanning electrode 63 is +½V and the potential of counter electrodes 11 and 13 is -½V, the potential (driving voltage) of electrostatic actuators $C_{31}$ and $C_{33}$ is +V (FIG. 12A). However, when electrostatic actuators 50 in the next line are scanned, the potential of the scanning electrode 64 is −½V, and the potential of the counter electrodes 11 and 13 is +½V, so that the potential of electrostatic actuators $C_{41}$ and $C_{43}$ is −V (FIGS. 12B and 12C). Because the number of the scanning electrodes 60 is odd, the polarities of the electrostatic actuators 50 in each line are inverted in every cycle, so that electrification generated in the electrostatic actuators 50 can be eliminated. The polarities of the potential of the scanning electrodes 60 and the counter electrodes 10 may be inverted in every cycle of scanning. In this case, the number of the scanning electrodes 60 may be even.

FIG. 12A shows an example in which a scanning electrode 63 is scanned, and a voltage is applied to counter electrodes 11 and 13 (outputting printing data), so that electrostatic actuators $C_{31}$ and $C_{33}$ are driven. In addition, FIGS. 12B and 12C show examples in which scanning electrodes 64 are scanned. In FIG. 12B, electrostatic actuators $C_{41}$ and $C_{43}$ are driven by applying a voltage to counter electrodes 11 and 13. In FIG. 12C, electrostatic actuators $C_{41}$ and $C_{43}$ are driven by applying a voltage to counter electrodes 12 and 14.

Embodiment 4.

Figure 13:
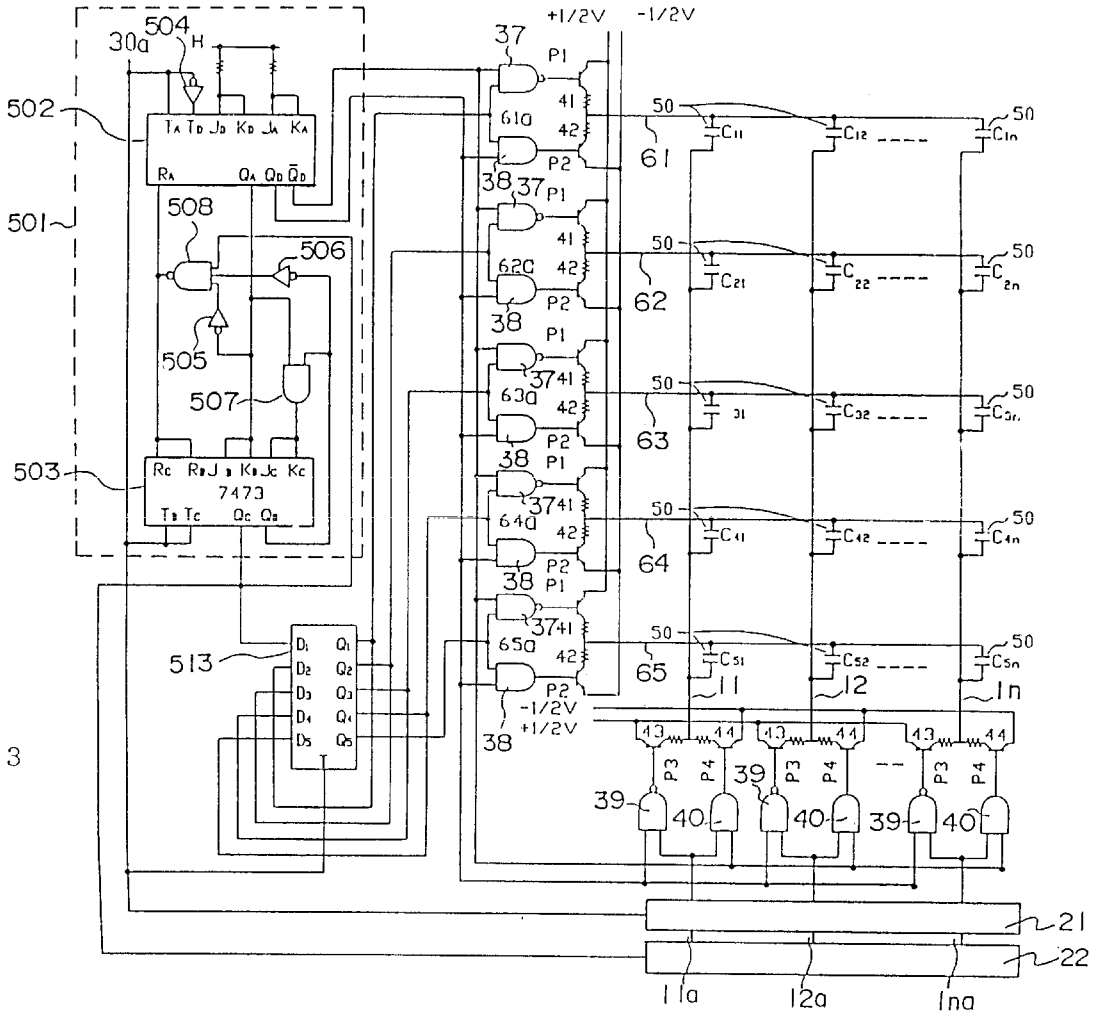
FIG. 13 is a circuit diagram showing an example of a control circuit in an ink jet head according to a fourth embodiment of the present invention.
Figure 14:
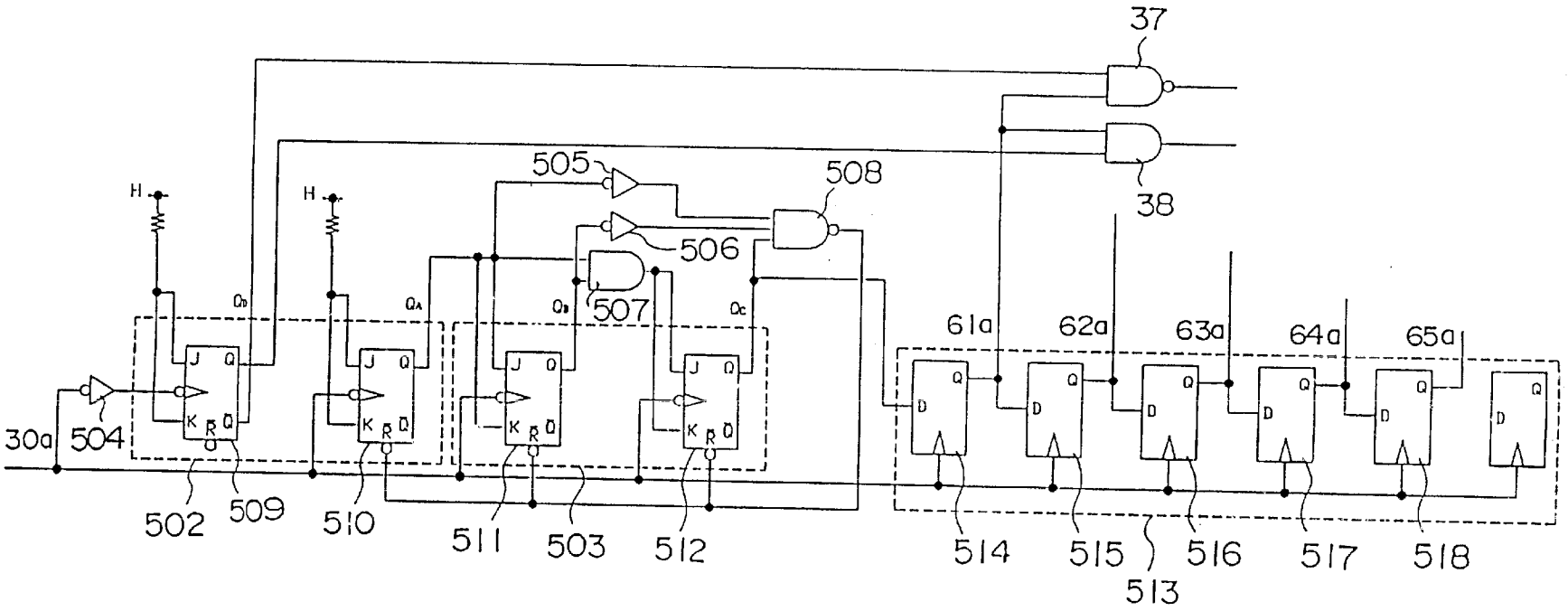
FIG. 14 is a circuit diagram showing in detail a part of the control circuit in FIG. 13.
Figure 15:
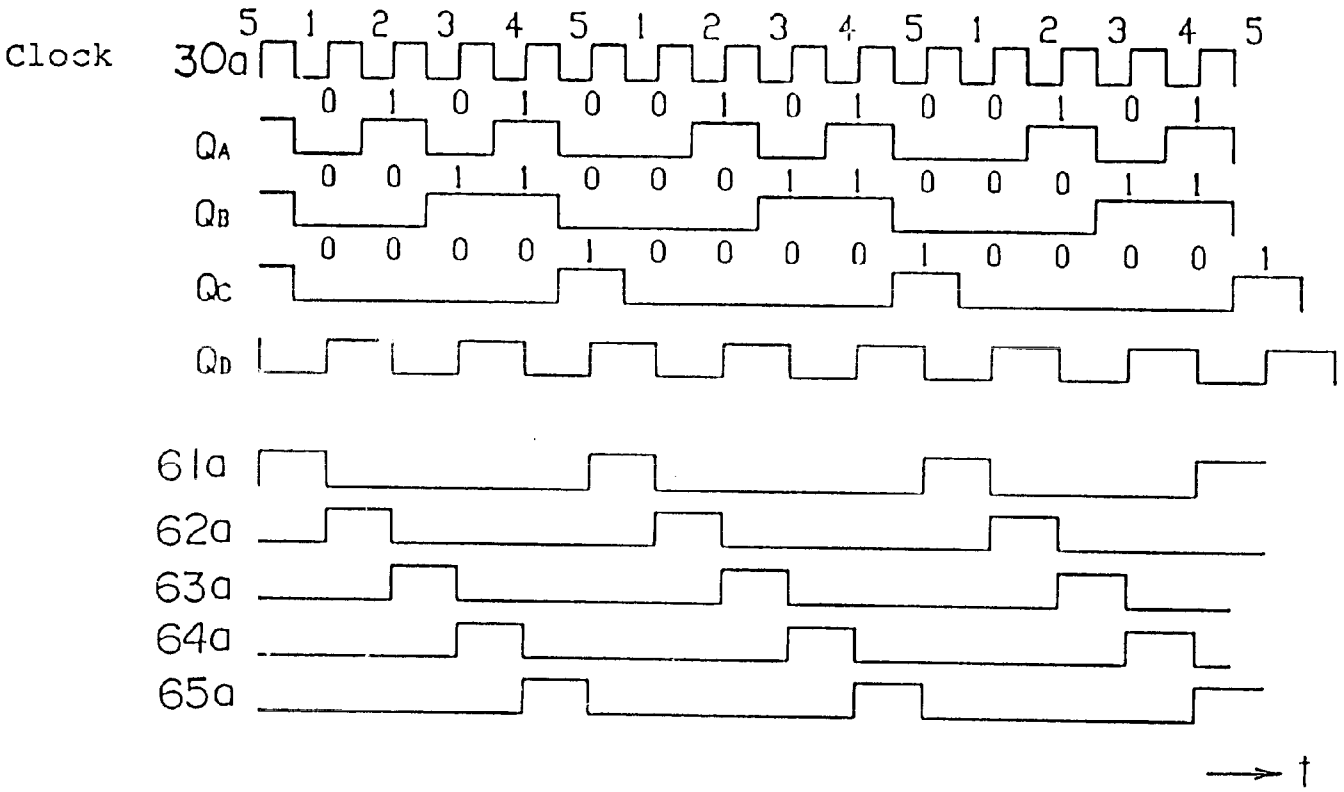
FIG. 15 is a timing chart showing the operation of the control circuit in FIG. 13.

FIG. 13 is a circuit diagram showing an example of control circuit in the case where the number of scanning electrodes is odd (here, showing an example of five) and the directions of electric fields of electrostatic actuators 50 are inverted in every line. FIG. 14 is a circuit diagram showing in detail a part of FIG. 13. In addition, FIG. 15 is a timing chart showing the operation of the control circuit. Incidentally, a flip-flop circuit is abbreviated to "FF" in the following description.

A clock 30*a* is counted by a pull-carry synchronizing quinary counter 501. This synchronizing quinary counter 501 is constituted by logical ICs 502 and 503, inverters 504 to 506, an AND circuit 507, and a NAND circuit 508. The logical IC 502 includes JK-FFs 509 and 510, and the logical IC 503 includes JK-FFs 511 and 512.

Outputs QA, QB and QC of the respective stages of the JK-FFs 510, 511 and 512 are frequency-divided into ½ respectively, and counted in binary codes. Here, when the count reaches "5" (100 in binary codes), an L-level output is supplied from the NAND circuit 508 to respective reset terminals of the JK-FFs 510, 511 and 512, so that the outputs QA, QB and QC of the respective stages are reset to "0". The reason why a synchronizing counter is used in this embodiment is to avoid a hazard which may be caused by delay of the outputs of the respective stages at the time of reset in an asynchronous system.

Next, the thus generated pulse QC with a 5-clock period is supplied to a logical IC 513. The logical IC 513 includes D-FFs 514 to 518 (the logical IC 513 includes other D-FFs, but no reference numerals are given to those other D-FFs because they are not used in this embodiment), and delays the pulse QC successively over the five stages through the D-FFs 514 to 518 synchronously with the clock 30*a*. This pulse is extracted at the respective stages of the D-FFs 514 to 518 to obtain line scanning pulses 61*a*, 62*a*, 63*a*, 64*a* and 65*a* to be used for scanning five lines (scanning electrodes 61, 62, 63, 64 and 65) of the associated head respectively, as will be described below.

Next, description will be made about the operation to invert an electric field in every line. The J-FF 509 of the above-mentioned logical IC 502 generates a pulse QD frequency-divided into ½, and its inverted pulse (these pulses will be signals for inverting an electric field). In order to make the leading edge of these pulses coincident with that of the line scanning pulse 61*a*, the clock 30*a* is inverted by the inverter 504 and then supplied to the JK-FF 509.

The inverted pulse of the pulse QD is at the H level at the timing of scanning the first line. NAND logic between the inverted pulse of the pulse QD and the line scanning pulse 61*a* is obtained in a NAND circuit 37. A NAND output P1 of the NAND circuit 37 is at the L level as the inverted pulse of the pulse QD is at the H level. A transistor (PNP type) 41 connected to +½V is turned ON by this output P1 and +½V is applied to the scanning electrode 61. At this time, AND logic between the pulse QD and the line scanning pulse 61*a* is obtained in an AND circuit 38. An AND output P2 of the AND circuit 38 is at the L level as the pulse QD is at the L level. Consequently, a transistor (NPN type) 42 connected to the output P2 is turned OFF, so that +½V is not applied to the scanning electrode 61.

On the other hand, an input means 22 detects the start of a scanning cycle on the basis of the leading edge of the pulse QC, and supplies printing data 11*a*, 12*a* to 1n*a* to a latch circuit 21. The printing data 11*a*, 12*a* to 1n*a* held in the latch circuit 21 are outputted synchronously with the clock 30*a*. Specifically, printing data corresponding to the above-mentioned line scanning pulse 61*a* are outputted. At this time, AND logic between the inverted pulse of the pulse QD and the printing data is obtained in an AND circuit 40. An AND output P4 of the AND circuit 40 is at the H level as the inverted pulse of the pulse QD is at the H level (if printing data exist). A transistor (NPN type) 44 connected to −½V is turned ON by this output P4, so that −½V is applied to the counter electrodes (11 to 1n). At this time, NAND logic between the pulse QD and the printing data is obtained in a NAND circuit 39. Therefore, a NAND output P3 of the NAND circuit 39 is at the H level because the pulse QD is in the L level. Consequently, a transistor (PNP type) 43 connected to this output P3 is turned OFF, so that +½V is not applied to the counter electrodes (11 to 1n).

When a voltage of +½V is applied in the above-mentioned manner to the scanning electrode 61 and a voltage of −½V is applied to the counter electrodes (11 to 1n) corresponding to the printing data corresponding to the scanning electrodes 61, the electrostatic actuators 50 in which the difference between the two applied voltages takes a value of V are actuated to eject ink drops.

Next, description will be made about the operation to invert an electric field at the time when the second line is scanned. The pulse QD of the JK-FF 509 of the logical IC 502 is at the H level at the timing corresponding to the scanning of the second line. AND logic between the pulse QD and the line scanning pulse 62*a* is obtained in the AND circuit 38. The AND output P2 of the AND circuit 38 is at the H level as the pulse QD is at the H level. The transistor (NPN type) 42 connected to −½V is turned ON by this output P2 so that −½V is applied to the scanning electrode 62. Then, the NAND output P1 of the NAND circuit 37 is at the H level, so that the transistor (PNP type) 41 is OFF.

On the other hand, printing data 11*a* to 1n*a* corresponding to the line scanning pulse 62*a* are outputted from the latch circuit 21 in the same manner as in the first line scanning. NAND logic between the pulse QD (H level) and the printing data is obtained in the NAND circuit 39, and the NAND output P3 is outputted. This output P3 is at the L level. The transistor (PNP type) 43 connected to +½V is turned ON by this output P3, so that +½V is applied to the counter electrodes (11 to 1n). At this time, AND logic between the inverted pulse of the pulse QD and the printing data is obtained in the AND circuit 40. The AND output P4 of the AND circuit 40 is at the L level. Consequently, the transistor (NPN type) 44 is OFF, so that −½V is not applied to the counter electrodes (11 to 1n).

When a voltage of −½V is applied in the above-mentioned manner to the scanning electrode 62 and a voltage of +½V is applied to the counter electrodes (11 to 1n) corresponding to the printing data corresponding to the scanning electrode 62, the electrostatic actuators 50 in which the difference between the two applied voltages takes a value of −V are actuated to eject ink drops.

Next, similar operation is repeated upon the scanning electrodes 63 to 65, so that driving voltages of +V and −V are applied, alternately in accordance with the scanning, to the electrostatic actuators 50 in the respective lines. When one cycle of scanning is finished and the second cycle of scanning is started, the H/L levels of the pulse QD frequency-divided into ½ of the clock 30*a* and its inverted pulse are reversed to those in the first cycle at the time of scanning of the first line in the next cycle because the number of lines is odd. Accordingly, the driving voltage of the electrostatic actuators 50 is also reversed. That is, driving voltages of −V and +V are applied to the respective actuators alternately in accordance with the scanning. Consequently, the direction of charging the respective actuators 50 is switched between the forward direction and the reverse direction alternately. Accordingly, residual charge after ejection is erased, and the quantity of relative displacement between the diaphragm and the electrodes is stabilized at the time of printing.

Embodiment 5.

Figure 16:
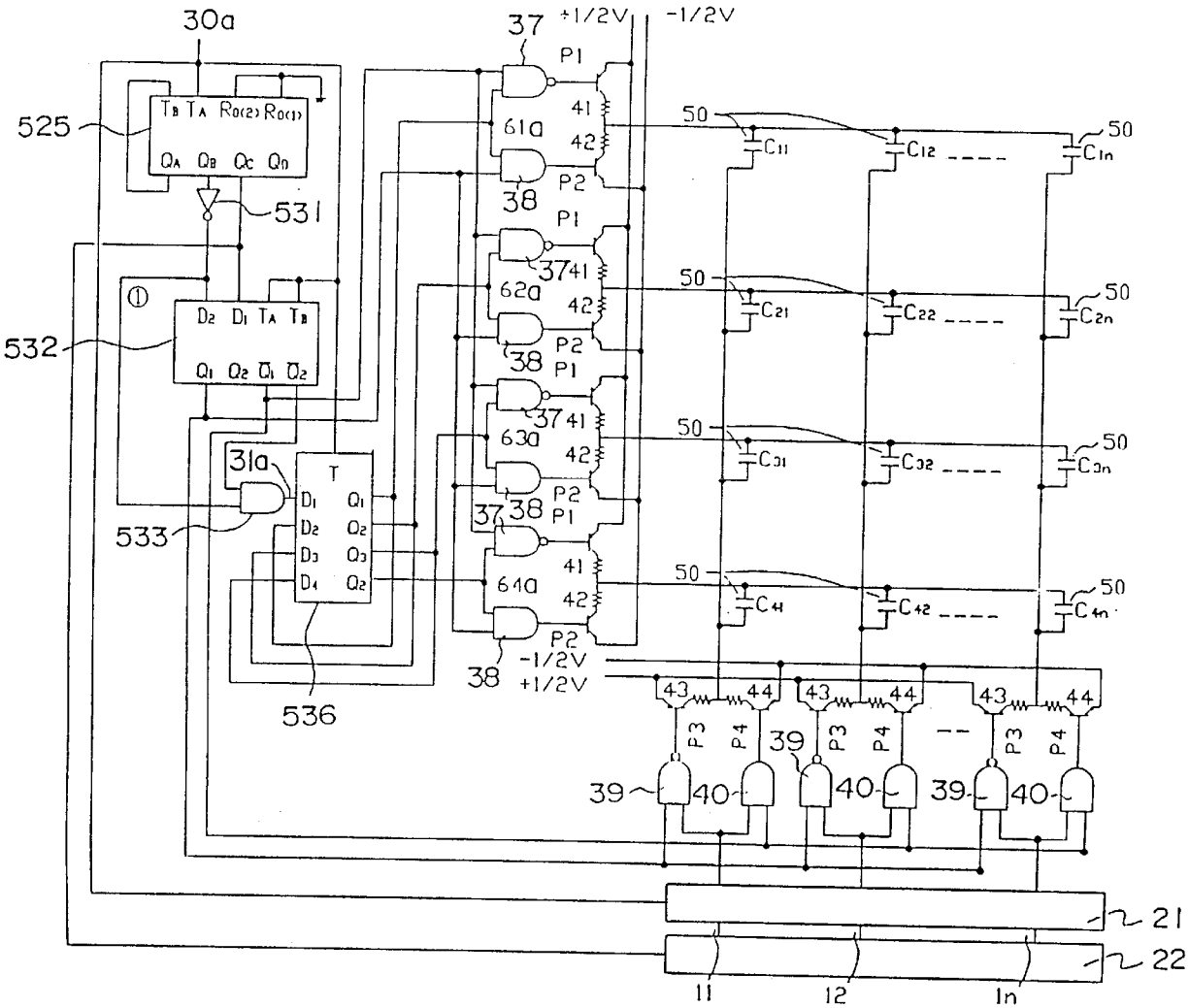
FIG. 16 is a circuit diagram showing an example of a control circuit in an ink jet head according to a fifth embodiment of the present invention.
Figure 17:
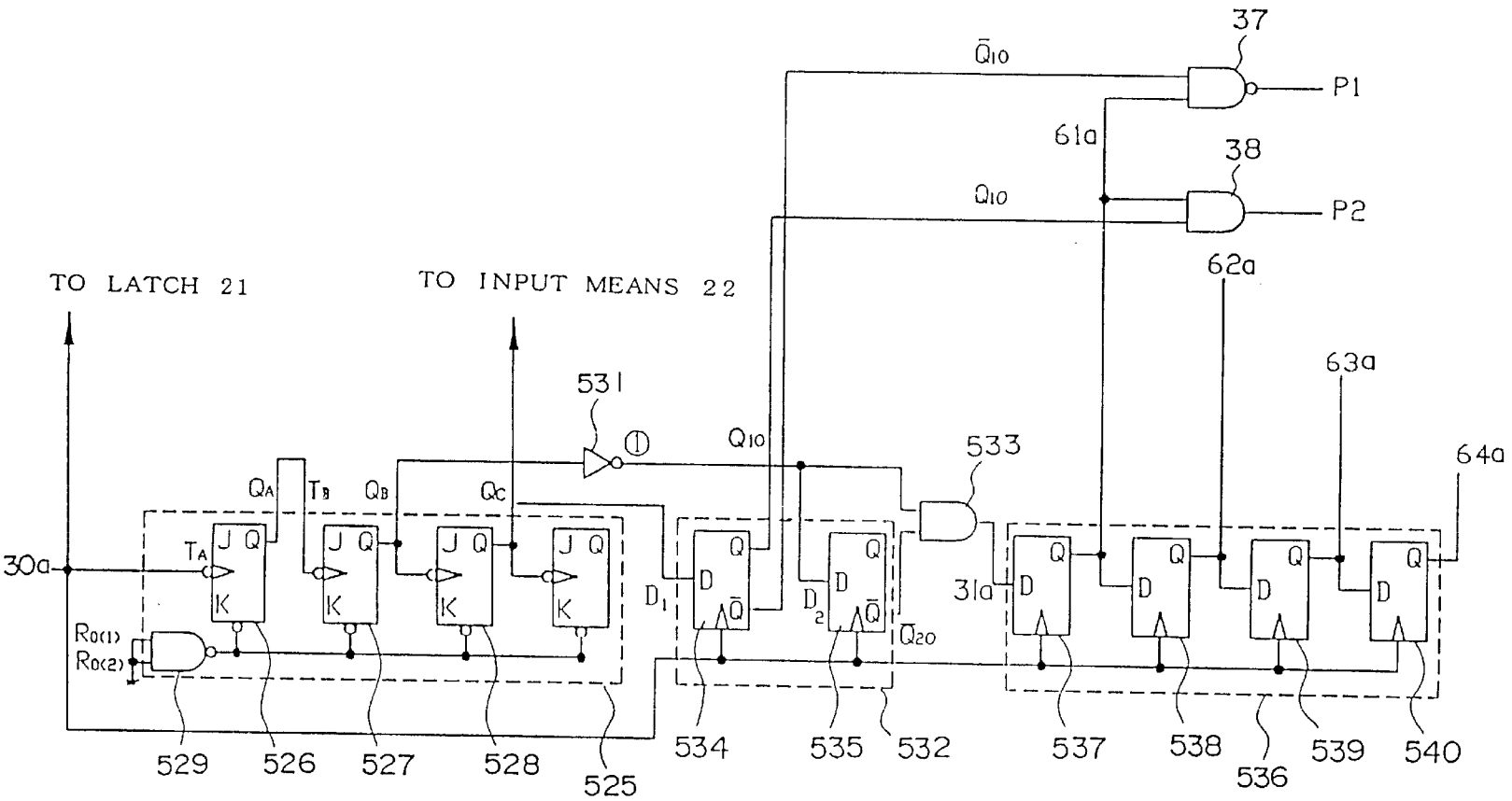
FIG. 17 is a circuit diagram showing in detail a part of the control circuit in FIG. 16.
Figure 18:
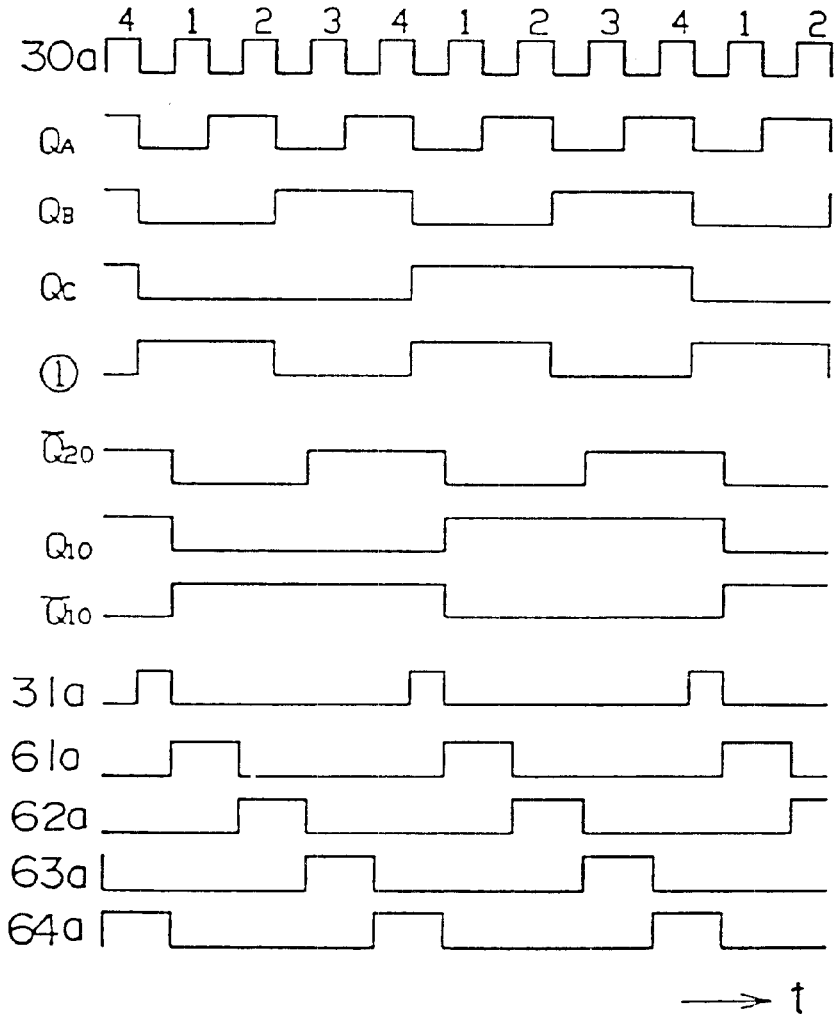
FIG. 18 is a timing chart showing the operation of the control circuit in FIG. 16.

FIG. 16 is a circuit diagram showing an example of control circuit in the case where the direction of the electric fields of electrostatic actuators 50 are inverted in every scanning cycle. FIG. 17 is a circuit diagram showing a part of FIG. 16 in detail. FIG. 18 is a timing chart showing the operation of the control circuit.

A clock 30*a* is frequency-divided by a three-digit down counter 525. This down counter 525 is constituted by JK-FFs 526 to 528 and a NAND circuit 529. A pulse QB frequency-divided in the second stage of the counter 525 is inverted by an inverter 531, and supplied to a logical IC 532 and an AND circuit 533.

The logical IC 532 is constituted by two D-FFs 534 and 535. When the D-FF 535 receives the output of the inverter 531, its inverted output is at the L level synchronously with the clock 30*a*. This inverted output and the output of the inverter 531 are supplied to the AND circuit 533, so that a synchronized differential output 31*a* having the same pulse width as the clock 30*a* and corresponding to the output of the inverter 531 is obtained as the output of the AND circuit 533. This synchronized differential output 31*a* is supplied to a logical IC 536. This logical IC 536 is constituted by four D-FFs 537 to 539. The synchronized differential output 31*a* is delayed in each stage synchronously with the clock 30*a*. This pulse is extracted at each stage of the D-FFs 537 to 539 so as to be used as line scanning pulses 61*a*, 62*a*, 63*a* and 64*a* for scanning four lines (scanning electrodes 61, 62, 63 and 64) of the associated head.

Next, description will be made about the operation to invert an electric field in every scanning cycle. The JK-FF 538 of the above-mentioned down counter 525 generates a frequency-divided pulse QC in the third stage. In order to make the leading edge of this pulse QC coincident with the line scanning pulse 61*a*, the pulse QC is delayed by the D-FF 534 of the logical IC 532, and then a pulse Q10 and its inverted pulse are extracted (these pulses will be signals for inverting an electric field in every scanning cycle).

The inverted pulse of the pulse Q10 is at the H level at the timing of scanning in the first cycle. NAND logic between the inverted pulse of the pulse Q10 and the line scanning pulse 61*a* is obtained in a NAND circuit 37. A NAND output P1 of the NAND circuit 37 is at the L level as the inverted pulse of the pulse Q10 is at the H level. A transistor (PNP type) 41 connected to +½V is turned ON by this output P1, so that +½V is applied to the scanning electrode 61. At this time, an AND output P2 of an AND circuit 38 is at the L level. Consequently, a transistor (NPN type) 42 is OFF.

On the other hand, an input means 22 detects the start of a scanning cycle on the basis of the trailing edge of the pulse QC, and supplies printing data 11*a* to 1n*a* to a latch circuit 21. The printing data 11*a* to 1n*a* held in the latch circuit 21 are outputted synchronously with the clock 30*a*. Specifically, printing data corresponding to the above-mentioned line scanning pulse 61*a* are outputted. At this time, AND logic between the inverted pulse of the pulse Q10 and the printing data 11*a* to 1n*a* is obtained in the AND circuit 40. An AND output P4 of the AND circuit 40 is at the H level as the inverted pulse of the pulse Q10 is at the H level. A transistor (NPN type) 44 connected to −½V is turned ON by this output P4, so that −½V is applied to the counter electrodes (11 to 1n).

When a voltage of +½V is applied to the scanning electrode 61 and a voltage of −½V is applied to the counter electrodes (11 to 1n) corresponding to the printing data corresponding to the scanning electrode 61 in the above-mentioned manner, the electrostatic actuators 50 in which the difference between the two applied voltages takes a value of V are actuated so that ink drops are ejected.

The scanning electrodes 62 to 64 are also scanned sequentially, and similar operation is repeated thereon.

Next, description will be made about the operation to invert an electric field in the second cycle of scanning. The pulse Q10 of the D-FF 534 of the logical IC 532 is at the H level at the timing of scanning in the second cycle. AND logic between the pulse Q10 and the line scanning pulse 61*a* is obtained in the AND circuit 38. The AND output P2 of the AND circuit 38 is at the H level as the pulse Q10 is at the H level. The transistor (NPN type) 42 connected to −½V is turned ON by this output P2, so that −½V is applied to the scanning electrode 61. Then, the NAND output P1 of the NAND circuit 37 is at the H level, so that the transistor (PNP type) 41 is OFF.

On the other hand, printing data 11*a* to 1n*a* corresponding to the line scanning pulse 61 a are outputted from the latch circuit 21 in the same manner as in the first cycle scanning. NAND logic between the pulse Q10 (H level) and the printing data is obtained in the NAND circuit 39, and the NAND output P3 is outputted. This output P3 is at the L level. The transistor (NPN type) 43 connected to +½V is turned ON by this output P3, so that +½V is applied to the scanning electrode 61. At this time, AND logic between the pulse Q10 and the printing data is obtained in the AND circuit 40. The AND output P4 of the AND circuit 40 is at the L level. Consequently, the transistor (NPN type) 44 is OFF, so that −½V is not applied to the counter electrodes (11 to 1n).

When a voltage of−½V is applied to the scanning electrode 61 and a voltage of +½V is applied to the counter electrodes (11 to 1n) corresponding to the printing data corresponding to the scanning electrode 61 in the above-mentioned manner, the electrostatic actuators 50 in which the difference between the two applied voltages takes a value of −V are actuated so that ink drops are ejected.

The scanning electrodes 62 to 64 are also scanned sequentially, and similar operation is repeated thereon.

Embodiment 6.

Figure 19:
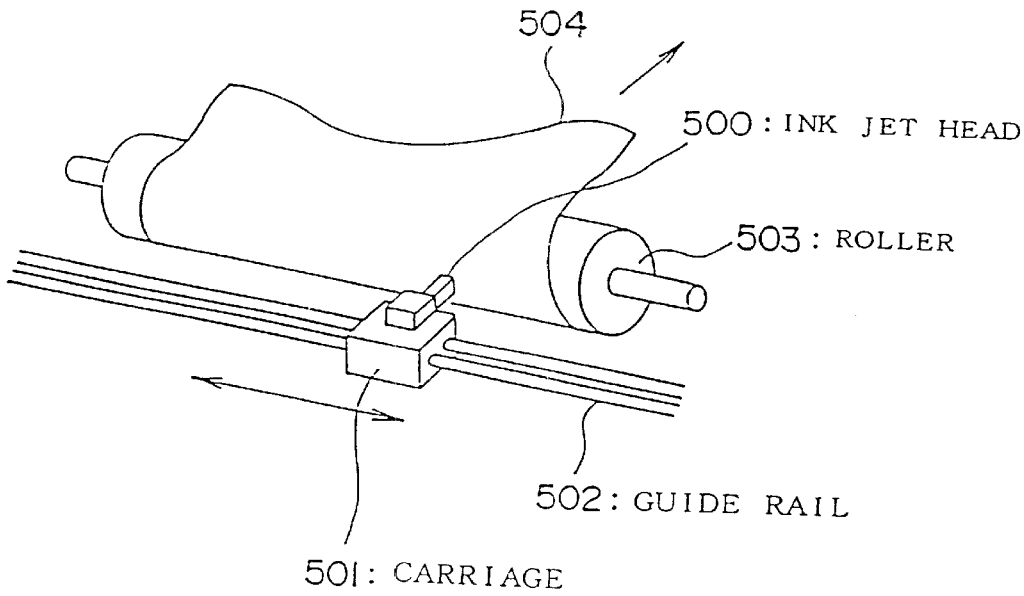
FIG. 19 is an explanatory view showing a peripheral mechanism of the ink jet head in the first to fifth embodiments.
Figure 20:
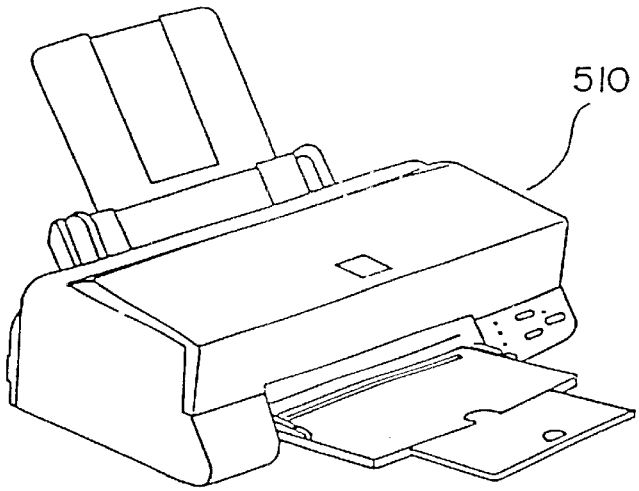
FIG. 20 is an outline view of an ink jet recording apparatus including the mechanism of FIG. 19.
Figure 21:
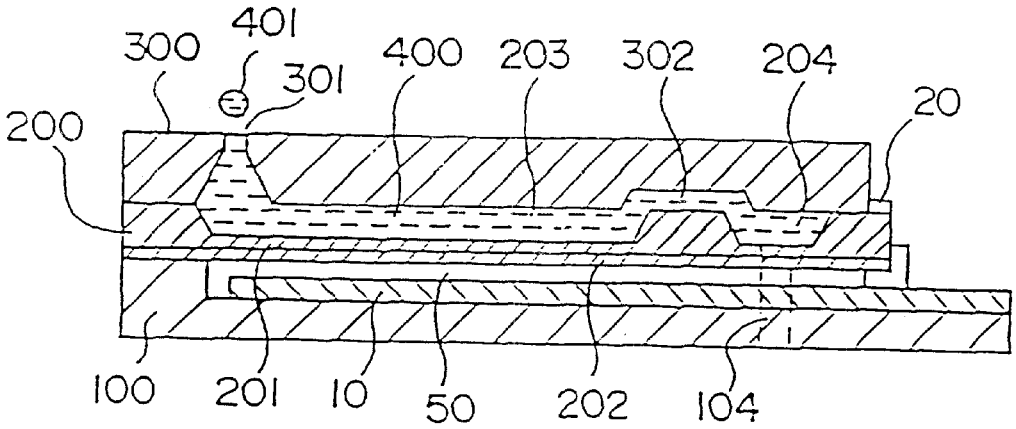
FIG. 21 is a sectional view of a conventional ink jet head driven by electrostatic actuators.
Figure 22:
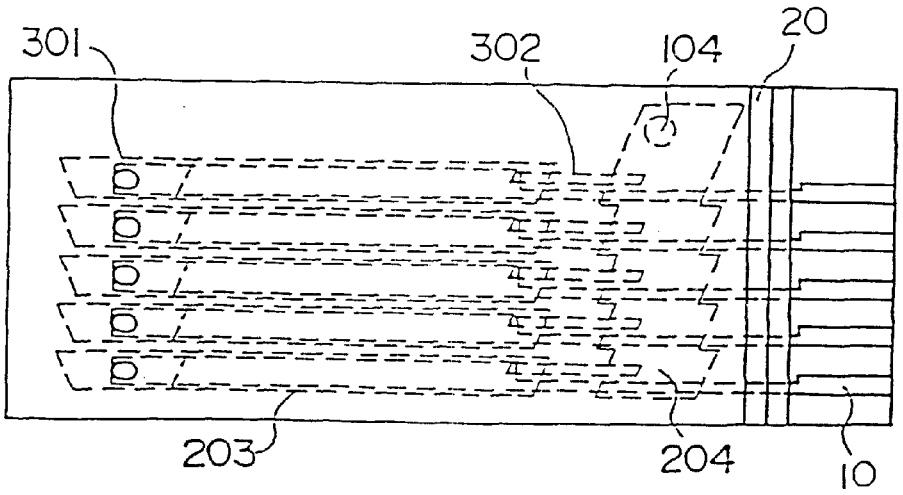
FIG. 22 is a plan view of the ink jet head in FIG. 21.

An ink jet head 500 according to the above-mentioned embodiments is attached to a carriage 501 as shown in FIG. 19. This carriage 501 is attached to guide rails 502 movably, and the position of the carriage 501 is controlled in the width direction of paper 504 fed out by a roller 503. This mechanism in FIG. 190 is mounted on an ink jet recording apparatus 510 shown in FIG. 20. This ink jet head 500 may be mounted as a line head of a line printer. In that case, the carriage is not required.

Embodiment 7.

Although the above-mentioned embodiments have been described about the case where electrodes formed on the diaphragm side are used as scanning electrodes, counter electrodes may be otherwise made to be scanning electrodes, so that printing data are supplied to the electrodes formed on the diaphragm side.

What is claimed is:

1. An ink jet head comprising a plurality of nozzle holes, said nozzle holes being arranged in a matrix of horizontal rows and vertical columns, a plurality of independent ejection chambers communicating with said nozzle holes respectively, diaphragms constituting at least one-side walls of said ejection chambers respectively, counter electrodes opposite to said diaphragms through air gaps respectively, and a control circuit for applying electric pulses between said diaphragms and said electrodes to charge/discharge therebetween to thereby transform said diaphragms to eject ink drops from said nozzle holes, wherein electrostatic actuators are electrically constituted by said diaphragms and the counter electrodes so that said electrostatic actuators respectively are arranged in a matrix corresponding to said nozzle holes.

2. An ink jet head according to claim 1, wherein said diaphragms comprise respective electrodes the potentials of which are controlled individually are formed on said diaphragms respectively.

3. An ink jet head according to claim 2, wherein said control circuit scans the potential of either said electrodes formed on said diaphragms or said counter electrodes sequentially.

4. An ink jet head according to claim 3, wherein said control circuit applies voltages to said counter electrodes with polarity opposite to that of voltages applied to said electrodes formed on said diaphragms respectively.

5. An ink jet head according to claim 3, wherein said control circuit allocates ink colors to electrodes to be scanned respectively when said control circuit controls said electrodes.

6. An ink jet head according to claim 2, wherein said control circuit periodically inverts the polarity of electrical pulses applied between said electrodes formed on said diaphragm and said counter electrodes respectively.

7. An ink jet head according to claim 6, wherein said control circuit inverts the polarity of the electrical pulses applied between said electrodes formed on said diaphragms and said counter electrodes whenever said control circuit scans an electrode to be scanned.

8. An ink jet head according to claim 6, wherein said control circuit inverts the polarity of electrical pulses applied between said electrodes formed on said diaphragms and said counter electrodes respectively whenever said control circuit finishes scanning over all of the electrodes to be scanned.

9. An ink jet recording apparatus, wherein said apparatus is mounted with an ink jet head defined in claim 1.

10. An ink jet head according to claim 1, wherein said electrostatic actuators are arranged in a matrix of n (n=an integral number) lines four columns, and wherein said electrostatic actuators of four columns perform printing of one dot.

11. An ink jet head according to claim 10, wherein said electrostatic actuators of four columns eject respectively red ink, green ink, blue ink, and black ink.

12. An ink jet head according to claim 1, wherein said electrostatic actuators are arranged in a row and electrically driven by matrix drive.

13. An ink jet head according to claim 12, wherein said counter electrodes are formed with meanderings, wherein said scanning electrodes are formed on the diaphragm side, and wherein each of said scanning electrodes is disposed correspondingly meanderings of said counter electrodes.

14. An ink jet head according to claim 1, wherein said diaphragms are constituted by cutting and dividing a diaphragm substrate into a plurality of regions isolated electrically.

15. An ink jet head according to claim 14, wherein said diaphragm substrate is divided into four pieces to constitute said electrostatic actuators of four columns.

* * * * *